US007212772B2

(12) United States Patent
Kasiske et al.

(10) Patent No.: US 7,212,772 B2
(45) Date of Patent: May 1, 2007

(54) SYSTEM AND METHOD FOR CREATING A THREE-DIMENSIONAL TEXTURE IN AN ELECTROPHOTOGRAPHIC IMAGE

(75) Inventors: W. Charles Kasiske, Penfield, NY (US); John L. Hryhorenko, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 264 days.

(21) Appl. No.: 11/063,063

(22) Filed: Feb. 22, 2005

(65) Prior Publication Data

US 2006/0188295 A1 Aug. 24, 2006

(51) Int. Cl.
*G03G 15/36* (2006.01)

(52) U.S. Cl. ..... 399/182; 399/341

(58) Field of Classification Search ..... 399/182, 399/183, 184, 341, 342; 430/45, 97
See application file for complete search history.

(56) References Cited

U.S. PATENT DOCUMENTS 5,234,783 A 8/1993 Ng ..... 430/45
2006/0187505 A1* 8/2006 Ng et al. ..... 358/518

* cited by examiner

*Primary Examiner*—Hoan Tran
(74) *Attorney, Agent, or Firm*—Lawrence P. Kessler

(57) ABSTRACT

An electrophotographic printer is configured to print a three-dimensional texture on a substrate by applying clear toner in locations corresponding to where texture is desired. The clear toner for texture may be applied either after, or before, other colors (e.g., CMYK) are applied to the substrate. The clear toner may be applied during the same pass as the other colors in an electrophotographic printer (10) having five imaging units (20C, 20M, 20Y, 20K, and 20X). Alternatively, the clear toner may be applied during a second pass of the substrate through the electrophotographic printer (10) if, on the first pass, all five imaging units are occupied with different colored toners. An electrophotographic printing system that includes a front-end station for scanning a document coupled to an electrophotographic printer (10) allows an operator to add texture to a scanned document.

17 Claims, 4 Drawing Sheets

SYSTEM AND METHOD FOR CREATING A THREE-DIMENSIONAL TEXTURE IN AN ELECTROPHOTOGRAPHIC IMAGE

CROSS-REFERENCE TO RELATED APPLICATIONS

This application is related to U.S. patent application Ser. No. 11/062,417, filed on even date herewith by Ng et al., entitled: "Profile Creation for Texture Simulation With Clear Toner".

FIELD OF THE INVENTION

The present invention relates generally to a method and system for using clear toner to impart texture to a printed image in a digital printing process.

BACKGROUND OF THE INVENTION

FIG. 1*a* shows a prior art electrophotographic (EP) printer 10, such as the NexPress® 2100. The electrophotographic (EP) printer 10 includes five imaging units (also referred to as development stations or electrostatographic image-forming modules) 20C, 20M, 20Y, 20K, and 20X. These stations are generally arranged in tandem and are shown in FIG. 1*a* in a specific arrangement with cyan, magenta, yellow, black, and a fifth station in order. Each station includes elements that are similar from station to station and are shown in FIG. 1*a* to have similar referenced numerals with a suffix of C, M, Y, and K to refer to the station to which such element is respectively associated. Since each station is identical in construction, the specific elements specified herein are shown in FIG. 1*a* at one station only, but should be understood to apply in like manner to each station. Each station includes a primary image-forming member, for example, a drum or roller, 22. Each roller 22 has a respective photoconductive surface 24 having one or more layers upon which an image or a series of images is formed. To form a toned image, the outer surface of the rollers 22 are uniformly charged by a primary charger such as a corona charging device 26, or by any other suitable charger such as a roller charger, a brush charger, etc. The uniformly charged surface 24, is typically exposed by an image writer or exposure device 28, which is generally an LED or other electro-optical exposure device. Any alternative exposure device may be used, such as an optical exposure device to selectively alter the charge on the surface 24 of the roller 22. The exposure device 28 creates an electrostatic image that corresponds to an image to be reproduced or generated. This electrostatic image is developed by applying marking particles to the latent image on the photoconductive drum 22 by a toner developing station 30. Each toner development station 30 is associated with a particular type of toner marking particle and magnetic carrier particle, which is typically in a preferred toner concentration and is attracted by a certain voltage supplied by a power supply (not shown). The image is transferred onto a transfer drum 32. After the transfer is made from the photoconductive drum 22, the residual toner image is cleaned from the surface 24 of the drum 22 by a suitable cleaning device 34. The cleaning device 34 then prepares the surface 24 of the drum 22 for reuse to form subsequent toner images. The intermediate or transfer drum 32 likewise is coated by a transfer surface 36, which can include one or more layers. The intermediate transfer drums 32 are each cleaned by respective cleaning devices 44 to prepare the transfer drums for reuse.

The imaging units 20C, 20M, 20Y, 20K, and 20X generally are in contact with a transport device, such as the shown endless belt or web 38, which can include receiver members adhered thereto for receipt of the paper or other media 15 that is to receive the image. In the alternative, the belt or web provided should not be restricted to the belt or web shown in FIG. 1*a* since the image transfer can be made on any suitable surface capable of receiving paper or other media as it passes between the imaging units. The web 38 can also detachably retain the paper electrostatically or by mechanical devices such as grippers. Typically, receiver members are electrostatically adhered to belt 38 by the deposit of electrostatic charges from a charging device, such as, for example, by using a corona charger 40. A sheet of paper 15 is shown in FIG. 1*a* proceeding along the belt 38 through each of the five imaging stations.

As shown in FIG. 1*a,* the transfer drum 32 interacts with the paper 15 along the belt 38 to transfer the electrostatic image from the transfer surface 36 of the transfer drum 32. The paper 15 then proceeds in tandem order through each developing station. Once the paper 15 has passed through each imaging unit 20, the paper 15 proceeds to a detack charger 42 to deposit a neutralizing charge on the paper 15 to separate the paper 15 from the belt 38. The paper 15 proceeds past the detack charger 42 and is transported to a remote location for operator retrieval. The transfer of images in each imaging unit 20C, 20M, 20Y, 20K, and 20X are performed without the application of heat to negate any fusing or sintering of toner images transferred to the paper 15 until the paper 15 enters a fuser 44 downstream. The paper 15 utilized herein can vary substantially in thickness and it is contemplated that this paper should not be limiting in any manner. For example, the paper can be thin or thick, include various paper stocks, transparencies stock, plastic sheet materials, and foils.

Although not shown, appropriate sensors of any well-known type, such as mechanical, electrical, or optical sensors, for example, generally are utilized in the printer to provide control signals for the printer. Such sensors may be located along the paper travel path, including along the belt 38, between the paper supply, and through the imaging units and the fusing station. Additional sensors may be associated with the photoconductive drums, the intermediate drums, any transferring mechanisms, and any of the image processing stations. Accordingly, the sensors can be provided to detect the location of the paper through its travel path in relation to each of the imaging units and can transmit appropriate signals indicative of the paper location. Such signals are input into a logic and control unit (not shown), which can include a microprocessor. Based on such signals and on the microprocessor, the control unit can output signals to the printer to control the timing operations of the various development stations or imaging units to process images and to control a motor (not shown) that drives the various drums and belts.

An electrophotographic system may include a front-end station 150 that is coupled either by wired, or wireless, connection, to the electrophotographic (EP) printer 10. As seen in FIG. 1*b,* the front-end station 150 may include a scanner 152 having a scanning head 154 for scanning documents. In addition, the front end station has a personal computer or the like, including a display 156, a keyboard 158 and a pointing device, such as a mouse 160 or the like, to interface with an operator. The front-end station may be a unit that is separate and distinct form the electrophotographic (EP) printer, as shown in FIG. 1*a,* or it may be part stand-alone unit. Software in the front-end station allows one to receive and edit job tickets, print process information, print content information, and the like.

The present invention addresses the problem of how to apply a three-dimensional texture to an electrophotographic image using an electrophotographic (EP) printer.

SUMMARY OF THE INVENTION

The present invention makes use of at least one imaging unit of an electrophotographic (EP) printer to impart three-dimensional texture to a substrate. The texture is imparted by causing the least one imaging unit to apply clear toner to the substrate, as dictated by textural data representing information as to where on the substrate the image texture is to be printed.

In one embodiment, the texture is applied to the entire substrate, including areas where no image is present at the time the substrate encounters the at least one imaging unit. In another embodiment, the texture is applied to only certain portions of the substrate. These certain portions may correspond to selected regions where objects are present on the finished print product.

In another aspect, the present invention is also directed to an electrophotographic (EP) printing system having a front-end station and an electrophotographic (EP) printer including a plurality of imaging units, at least one of which is configured to apply clear toner to a substrate. The front-end station is configured to scan a document and permit an operator to add texture before the document is sent to the electrophotographic (EP) printer.

In still another aspect, the present invention is directed to a method of applying a three dimensional texture to a substrate. The method includes providing an electrophotographic (EP) printer having a single imaging unit configured to apply clear toner to the substrate, sending digital information to the electrophotographic (EP) printer, the digital information including textural data sufficient to cause the single imaging unit to apply clear toner onto the substrate in sufficient quantity and with sufficient spatial distribution so as to form a visually and tactilely detectable three dimensional texture on the substrate, and applying clear toner to the substrate at the single imaging unit as dictated by the textural data to thereby create a three-dimensional texture.

An advantageous technical effect of the present invention is that textural information may be included in an image data file for an electrophotographic (EP) printer, to determine where a three-dimensional texture is to appear on a printed substrate.

DETAILED DESCRIPTION OF THE INVENTION

The present invention is described with reference to an electrophotographic (EP) printer having a plurality of imaging units of the sort discussed above with references to FIG. 1*a*. The electrophotographic (EP) printer accepts substrate having two sides, such as a sheet of paper, linen, or the like, and the various imaging units each transfer one color to a side of the substrate. It is understood, however, that the general concept of applying three-dimensional texture using clear toner, can be performed using other printers, as well. For example, a single module unit for making texture on preprinted material, not even necessarily electrophotographically produced, may be employed. Furthermore, the texture could be printed over inkjet or lithography produced prints, color or black and white.

In one embodiment, the textural data may be added to an existing image file. This can be done by either creating an additional image layer, or modifying a pre-existing layer, using an application such as Adobe Photoshop®. This additional image layer would contain the clear imaging data. For example, in an image file having layers corresponding to cyan, magenta, yellow, and black, a fifth image layer corresponding to clear texture, may be added. Alternatively, where a fifth image layer of clear toner already exists, this fifth layer may be modified to include the textural data. The electrophotographic (EP) printer software would then interpret the additional/modified layer and apply the clear toner, in due course.

Figure 2:
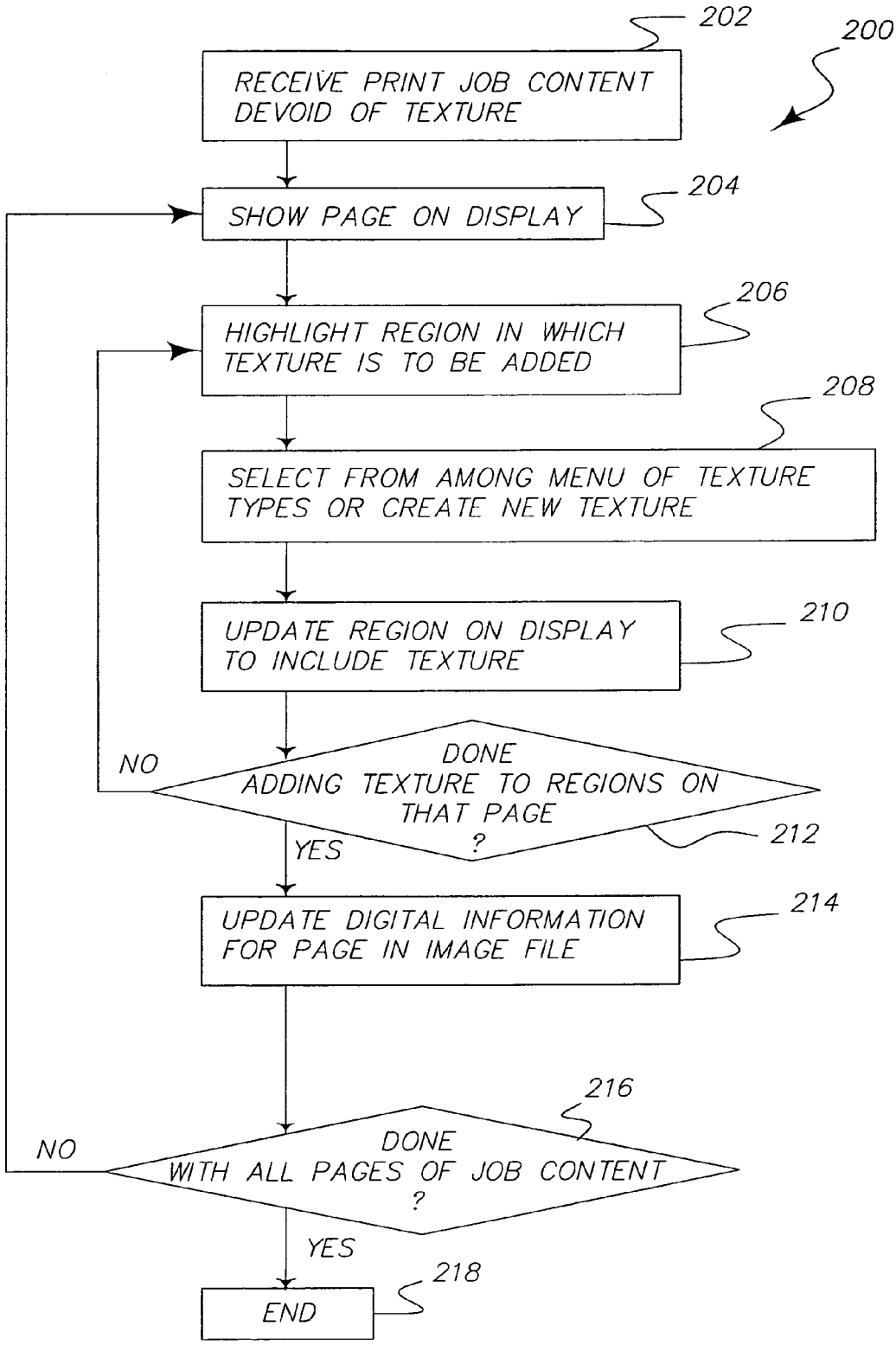
FIG. 2 illustrates the process of adding textural information to pages of print job content in accordance with the present invention.

FIG. 2 presents a flow chart 200 depicting an embodiment in which texture is added to an existing image file comprising print content to be printed over a number of pages. It is understood, however, that the number of pages that are to be printed is not critical and even one page would suffice. The image file, which typically has information corresponding to CMYK layers (and also perhaps a fifth, clear layer), is devoid of digital information corresponding to three-dimensional texture.

In step 202, an image file comprising print content is received at a pre-processing computer. The pre-processing computer preferably is a personal computer running one or more applications, such as the aforementioned Adobe Photoshop®, enhanced by a "texture plug-in" to facilitate use of the present invention.

In step 204, a first page of the print content is displayed on this computer. It is understood here that the original "CMYK" format is converted through known methods into RGB format for display. In step 206, the pre-processing computer receives input from an operator to select a first designated portion of the page where a first texture is to be added. In step 208, the computer displays a menu of textures from a tool bar or the like, permitting the operator to choose which "stock" texture to apply to the selected portion. Alternatively, the operator may be provided with the option of either using the underlying CMYK image data to providing the textural information (a "data driven texture") or creating an entirely new texture. In either case, the height of the textural features in the final print product may also be specified and received by the pre-processing computer. In step 210, the pre-processing computer displays the image with the textural pattern overlaying the designated portion.

As depicted by step 212, the operator is permitted to select additional designated portions and repeat steps 206, 208, and 210, it being understood that different features or portions of the same page may be provided with different textures. At step 214, the information in the image file is updated to reflect the changes to that page. As depicted by step 216, the operator is permitted to select another page and repeat the process until no additional texture remains to be added. The image file is then updated to include the textural data in the new/modified clear layer and is closed. The thus-modified image file may then be subjected to further editing prior to printing.

In a second embodiment, the textural information may be added at the printer level in a manner that is independent of the image file. If, for example, the printer has five modules, of which the first four are for applying the standard CMYK colors and the fifth is designated a "spot color" module, the texture may be added at a scanning station.

Figure 3:
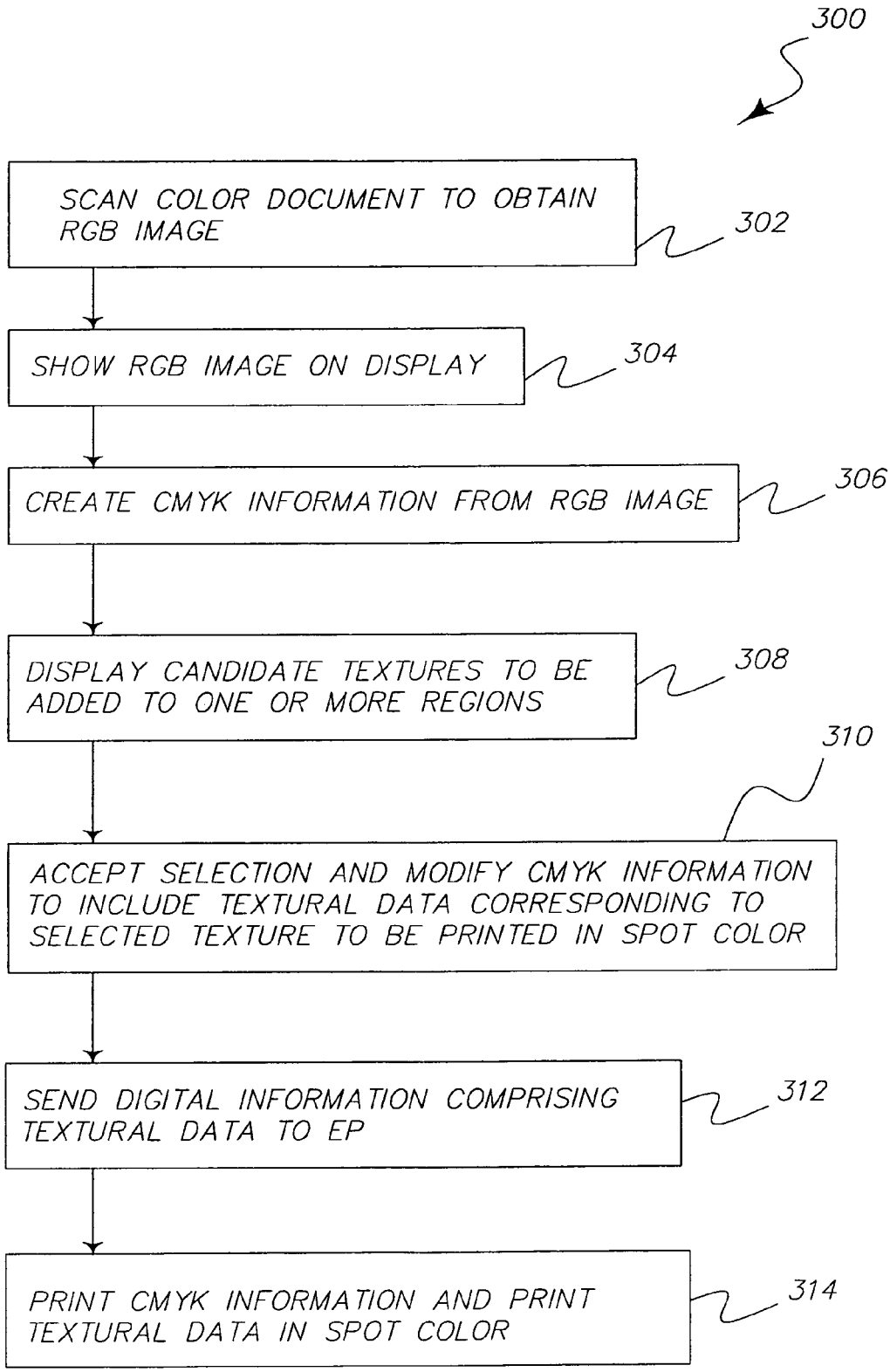
FIG. 3 illustrates the process of scanning a document and adding textural information in accordance with the present invention.

FIG. 3 presents a flow chart 300 depicting an embodiment in which texture is added "on the fly" to a scanned page. In step, 302, a color document is scanned to obtain an RBG image. In step 304, the associated computer displays this image and CMYK layers are created in step 306 from the RGB information in a known manner. Next, in step 308, candidate textures to be added to an operator-designated portion of the scanned page are displayed in a pull-down menu, or the like. In step 310, the computer receives one or more texture selections, and creates a spot color layer corresponding to the textural information. In step 312, the CMYK layers created in step 306, along with the newly formed spot color layer are sent to the EP, which in step 314, prints all five layers.

In one embodiment, an operator is given the option of selecting from among a plurality of candidate textures, but chooses to create an entirely new textural pattern instead. For this, the menu of candidate texture patterns includes options to "create a new texture" or "import a new texture file". When the "create a new texture" option is selected, the display goes into a drawing mode, and the operator is allowed to draw a new texture. The newly draw texture can be applied to any portion of the image, as determined by the operator. A further option allows the operator to save the new textural pattern and add it to the list of candidate textures for subsequent use. When the "import a new texture file" option is selected, the operator is allowed to identify a file, either on the local computer, a remote computer, and perhaps even specify a URL to import a texture file. Such an imported textural pattern may be saved and added to the list of candidate textures for subsequent use.

In one embodiment that uses an electrophotographic (EP) printer having at least five imaging units, four differently colored toners, e.g., cyan, magenta, yellow, and black (not necessarily in that order), are first applied to a first side of the substrate using four of the imaging units in accordance with digital information applied to the printer for those corresponding colors. The substrate then enters a fifth imaging unit, which is configured to apply clear toner to the first side of the substrate in accordance with the textural data in the fifth layer within the image file. After clear toner is applied to the first side of the substrate, the substrate is presented to a fusing unit for fusing the four colors and clear toner on the first side of the substrate, all at the same time.

In another embodiment that uses an electrophotographic (EP) printer having at least five imaging units, on a first pass of the substrate through the printer, four or five differently colored toners, e.g., cyan, magenta, yellow, black, and blue (when present) (and not necessarily in that order), are first applied to the first side of the substrate in accordance with digital information sent to the imaging unit for each corresponding color. On a second pass of the substrate through the printer, one of the five imaging units is replaced, modified, etc. to apply clear toner to the first side of the substrate. During this second pass, null data may be sent to the other four imaging units so that no additional colored toner is applied. After the second pass, the colored and clear toners on the first side of the substrate are subject to fusing. Alternatively, a first fusing operation may be performed after the first pass, and a second fusing may be performed after the second pass.

In yet another embodiment, the clear toner is applied to a first side of the substrate during a first pass of the substrate through the printer, with the remaining imaging units being presented with null data so that no color is printed. In a second pass, four or five colored toners are applied to the same first side of the substrate, thereby imparting image(s) and/or text to the substrate.

In yet another embodiment, only a single color, e.g., black, is applied, and the clear toner is applied on top of the single color. The texture can thus be applied using a electrophotographic (EP) printer having only two imaging units. The single color and the clear toner are then fused, as described above, thereby forming textural patterns on a monochrome image.

The second side of a substrate may also be printed on during additional pass(es) and so three-dimensional textural information may thus be provided on both sides of the substrate.

In all of the foregoing embodiments, the fusing is preferably done with one or more components having smooth surfaces so that they do not impart their own texture to the substrate.

The locations on the substrate at which the texture is applied depends on the texture data. Generally speaking, however, the textural pattern may be applied to the entire printable area of the substrate, or only on a portion of the substrate. As to the latter, the clear toner may be applied only to those image regions of the substrate at which one or more of cyan, yellow, magenta, and black are to be applied (in case the clear toner is applied first), or have already been applied (in case the clear toner is applied last). Alternatively, the clear toner may be applied only to some, but not all, image regions on the substrate. Another alternative is to apply the clear toner texture only to those non-image regions where none of CMYK, have been applied.

Furthermore, the texture data may call for different clear toner textures to be applied to different portions of the substrate. Thus, a first image region on the substrate may receive a first textural pattern, while a second image region on the same substrate may receive a second textural pattern. This allows one to produce a substrate bearing textures of different types on various portions thereof. Thus, for example, one image on the substrate's first side may bear a first texture while a second image on the same side of the substrate may bear a second texture.

The amount of toner applied, and the textural pattern, helps determine the height of the texture features, which, in turn, helps determine the "feel" of the texture. To be both visible and tactilely detectable, sufficient clear toner should be applied when creating a three-dimensional texture. Testing has shown that clear toner quantities on the order of at least 0.5 $mg/cm^2$ are sufficient for this. The upper quantity limit is determined by the capabilities of the electrophotographic (EP) printer imaging unit and the fusing unit. Generally, however, the clear toner quantity should be less than 5 $mg/cm^2$, and more preferably less than 1 $mg/cm^2$.

To ensure that the textural features are both visible and tactilely detectable, the textural features preferably have a spatial frequency of approximately 50–75 lines/inch, for a "ribbed" or "checkered" pattern. In addition, the textural features preferably have a post-fusing height of at least 0.001 mm relative to the surrounding area, so that they can be felt, upon running a finger over the surface. More preferably, however, this post-fusing height is between 0.003 and 0.010 mm.

It is further noted that texture may also be applied with less than 100% clear toner coverage on a pixel-by-pixel basis to create the textural features. This allows one to create textural formations having varying height. One example of this is when the clear toner is applied in an amount that is data driven. For example, in the embodiment of FIG. 2, at step 206, if a page includes a brushstroke as a feature, the operator may select that brushstroke region as a region to which three-dimensional texture is to be applied in the final printed product. At step 208, the operator may then select that the texture to be applied is "data driven". In such case, the clear toner layer is created based on the data in the CMYK layers for the brushstroke region. In one embodiment, clear toner is applied, pixel-by-pixel in the brushstroke region, in an amount corresponding to a normalized sum of the amounts in the CMYK layers for the corresponding pixels. This will likely result in the clear layer's brushstroke region having less than 100% clear toner in at least some pixels. Since the textural data for pixels in the brushstroke region are derived from one or more of cyan data, magenta data, yellow data, and black data for corresponding pixels in the brushstroke region, the final printed product will then have a feel much like the underlying brushstroke.

While the foregoing parameters are sufficient for visual appreciation of the texture, it is understood that factors such as substrate roughness, lighting, and distance from the printed product also influence the ability of a viewer to see the texture.

Figure 1A:
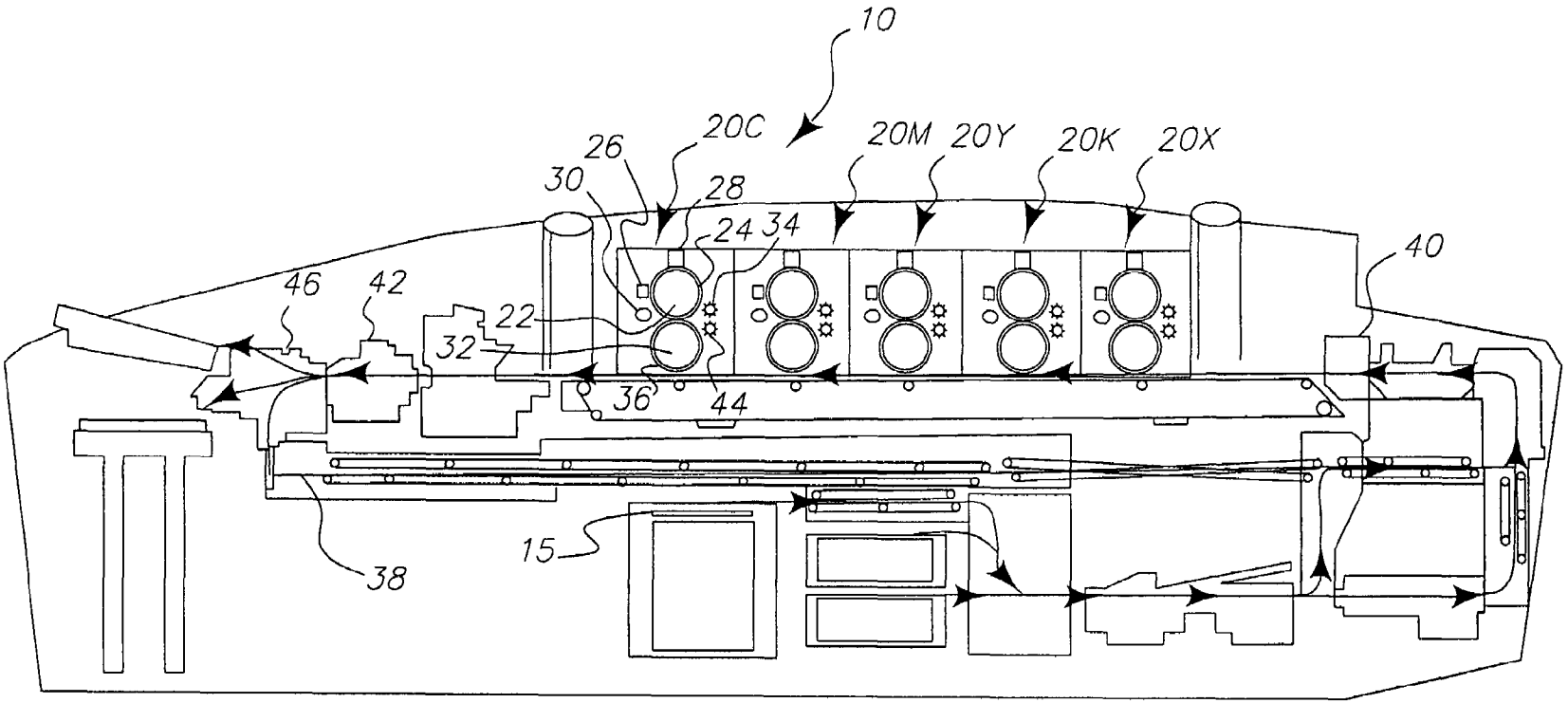
FIG. 1A (PRIOR ART)
FIG. 1*a* shows a prior art electrophotographic (EP) printer with five imaging units.
Figure 1B:
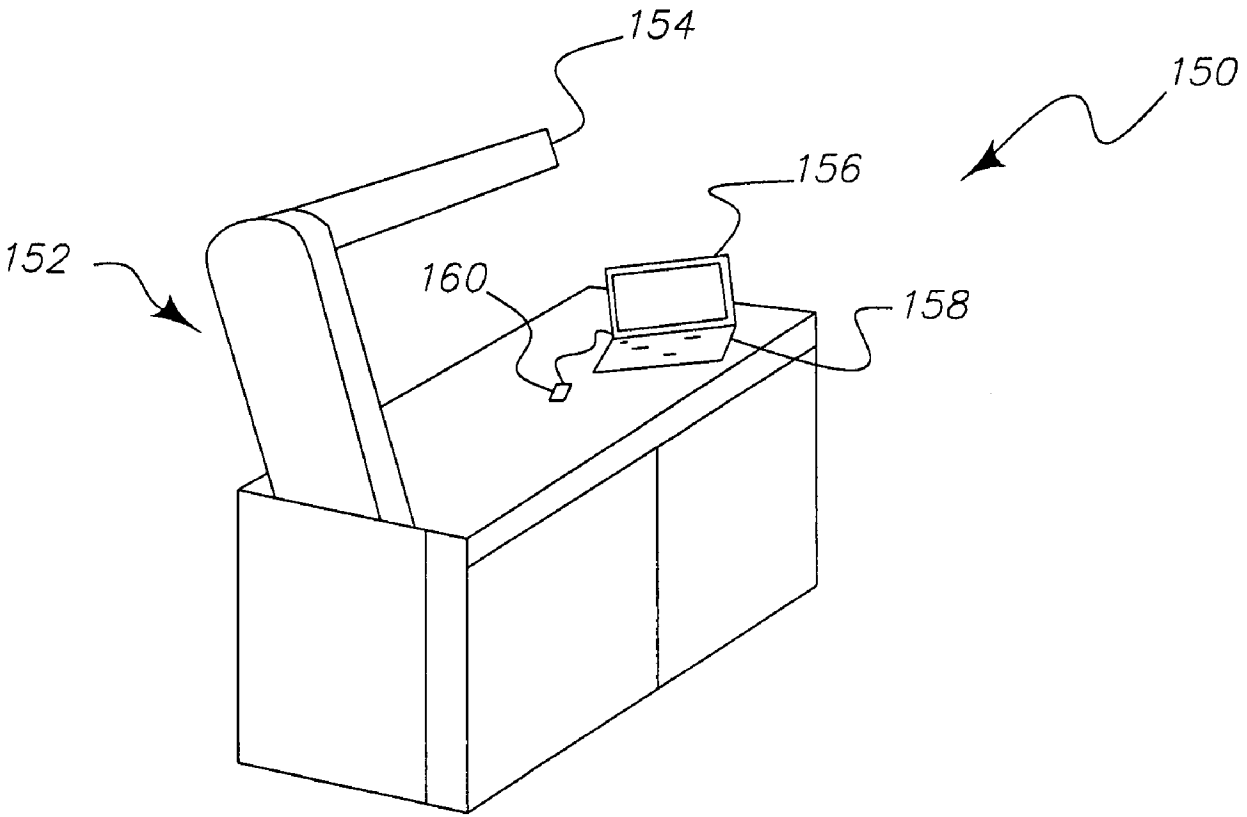
FIG. 1B (PRIOR ART)
FIG. 1*b* shows a prior art front-end station for use with an electrophotographic (EP) printer.

It is further understood that three-dimensional texture may be applied with clear toner using devices other than the electrophotographic (EP) printer 10 of FIG. 1*a*. For instance, three-dimensional texture may be applied by a device having a single imaging unit, provisioned with clear toner, and receiving digital information having textural data. Such a stand-alone unit may thus be fed substrates, which have previously been printed on with CMYK text and imagery, the clear toner then being applied atop the previously printed-on substrates.

While the invention has been disclosed in its preferred forms, it will be apparent to those skilled in the art that many modifications, additions, and deletions can be made therein without departing from the spirit and scope of the invention and its equivalents as set forth in the following claims.

PARTS LIST 10 printer
15 paper
20 imaging unit
22 drum/roller
24 surface
26 changer
28 exposure device
30 toner development station
32 transfer drum
34 cleaning device
36 transfer surface
38 belt or web
40 corona charger
42 detack charger
44 cleaning devices
46 fusing device
150 front-end station
152 scanner
154 scanning head
156 display
158 keyboard
160 pointing device

The invention claimed is:

1. A method of applying a three dimensional texture to a substrate comprising:

providing an electrophotographic printer (10) having a plurality of imaging units (20C, 20M, 20Y, 20K, and 20X), at least one of said plurality of imaging units configured to apply clear toner to the substrate; sending digital information to the electrophotographic printer, the digital information having textural data sufficient to cause said at least one of said plurality of imaging units to apply clear toner onto the substrate in sufficient quantity and with sufficient spatial distribution so as to form a visually and tactilely detectable three dimensional texture on said substrate; and applying clear toner to said substrate at said at least one of said plurality of imaging units as dictated by the textural data to thereby create a three-dimensional texture.

2. The method according to claim 1, wherein the electrophotographic printer (10) has at least five imaging units, and further comprising:

applying each of cyan, magenta, yellow, and black toners to said substrate prior to applying clear toner.

3. The method according to claim 2, further comprising fusing the substrate bearing cyan, magenta, yellow, black, and clear toners all at the same time.

4. The method according to claim 2, comprising:

applying clear toner to provide three-dimensional texture to said substrate only at regions on the substrate at which one or more of cyan, magenta, yellow, and black toner have previously been applied.

5. The method according to claim 2, comprising:

applying clear toner to provide three-dimensional texture to said substrate only at regions on the substrate at which none of cyan, magenta, yellow, and black toner have been applied.

6. The method according to claim 1, comprising:

selecting, from among a plurality of candidate textural patterns, a particular textural pattern to be applied to the substrate, wherein said textural data corresponds to said particular textural pattern.

7. The method according to claim 1, comprising:

creating a new textural pattern to be applied to the substrate, wherein said textural data corresponds to said new textural pattern, and the new textural pattern is not one from among a plurality of candidate textural patterns.

8. The method according to claim 7, comprising:

adding the new textural pattern to said plurality of candidate textural patterns for future use.

9. The method according to claim 1, comprising:

importing a new textural pattern to be applied to the substrate, wherein said textural data corresponds to the new textural pattern, and the new textural pattern is not one from among a plurality of candidate textural patterns.

10. The method according to claim 9, comprising:

adding the new textural pattern to said plurality of candidate textural patterns for future use.

11. The method according to claim 1, comprising:

deriving textural data, for pixels in a particular region, from one or more of cyan data, magenta data, yellow data, and black data for corresponding pixels in said particular region of the image.

12. The method according to claim 11, wherein said step of deriving comprises taking a normalized sum of pixel values.

13. The method according to claim 11, wherein the textural data corresponds to an image of a brushstroke.

14. The method according to claim 1, comprising:

sending digital information to the electrophotographic printer comprising textural data sufficient to apply a plurality of different three-dimensional textures to said substrate.

15. An electrophotographic printer system comprising a front end station (150) having a scanner (152) and an associated display (156), the front end station coupled to an electrophotographic printer (10) having a plurality of imaging units (20C, 20M, 20Y, 20K, and 20X), at least one of said imaging units configured to apply clear toner to a substrate, wherein the front end station is configured to:

scan a color document;

present a plurality of predetermined candidate textures that may be added to at least a portion of a scanned version of the document;

accept input corresponding to a selected texture from among said predetermined candidate textures; and send information to the electrophotographic printer comprising textural data corresponding to the selected texture, the textural data being sufficient to cause said at least one of said plurality of imaging units to apply clear toner onto a substrate in sufficient quantity and with sufficient spatial distribution so as to form a visually and tactilely detectable three dimensional texture on said substrate.

16. The electrophotographic printer system according to claim 15, wherein the electrophotographic printer is configured to:

apply clear toner to said substrate at said at least one of said plurality of imaging units as dictated by the textural data to thereby create a three-dimensional texture.

17. A method of applying a three dimensional texture to a substrate comprising:

providing an electrophotographic printer having a single imaging unit configured to apply clear toner to the substrate;

sending digital information to the electrophotographic printer, the digital information comprising textural data sufficient to cause said single imaging unit to apply clear toner onto the substrate in sufficient quantity and with sufficient spatial distribution so as to form a visually and tactilely detectable three dimensional texture on said substrate; and applying clear toner to said substrate at said single imaging unit as dictated by the textural data to thereby create a three-dimensional texture.

* * * * *